US005391288A

United States Patent [19]

Collins et al.

[11] Patent Number: 5,391,288

[45] Date of Patent: Feb. 21, 1995

[54] GASOLINE UPGRADING PROCESS

[75] Inventors: Nick A. Collins, Medford, N.J.; Paul P. Durand, Wilmington, Del.; David L. Fletcher, Turnersville, N.J.; Mohsen N. Harandi, Langhorne; Edward F. Kondis, New Hope, both of Pa.; Hartley Owen, Belle Mead, N.J.; Michael S. Sarli, Haddonfield, N.J.; Stuart S. Shih, Cherry Hill, N.J.

[73] Assignee: Mobil Oil Corporation, Fairfax, Va.

[21] Appl. No.: 74,572

[22] Filed: Jun. 10, 1993

Related U.S. Application Data

[63] Continuation-in-part of Ser. No. 961,592, Oct. 15, 1992, abandoned, which is a continuation-in-part of Ser. No. 850,106, Mar. 12, 1992, which is a continuation-in-part of Ser. No. 745,311, Aug. 15, 1991.

[51] Int. Cl.[6] ..... C10G 45/00; C10G 69/00

[52] U.S. Cl. ..... 208/89; 208/212

[58] Field of Search ..... 208/89, 212

[56] References Cited

U.S. PATENT DOCUMENTS

| | | | |
|---|---|---|---|
| 3,729,409 | 4/1973 | Chen | 208/135 |
| 3,751,506 | 8/1973 | Barress | 260/671 R |
| 3,759,821 | 9/1973 | Brennan | 208/93 |
| 3,767,568 | 10/1973 | Chen | 208/62 |
| 3,923,641 | 12/1975 | Morrison | 208/111 |
| 3,957,625 | 5/1976 | Orkin | 208/211 |
| 4,016,218 | 4/1977 | Haag et al. | 260/671 R |
| 4,049,542 | 9/1977 | Gibson | 208/213 |
| 4,062,762 | 12/1977 | Howard | 208/211 |
| 4,150,062 | 4/1979 | Garwood et al. | 208/71 |
| 4,209,383 | 6/1980 | Herout et al. | 208/93 |
| 4,419,220 | 12/1983 | La Perre et al. | 208/111 |
| 4,738,766 | 4/1988 | Fischer | 208/68 |
| 4,753,720 | 6/1988 | Morrison | 208/135 |
| 4,827,069 | 5/1989 | Kushnerick et al. | 585/415 |
| 4,827,076 | 5/1989 | Kokayeff | 208/213 |
| 4,911,823 | 3/1990 | Chen et al. | 208/67 |
| 4,997,543 | 5/1991 | Harandi et al. | 208/49 |
| 5,143,596 | 9/1992 | Maxwell | 208/89 |

OTHER PUBLICATIONS

Yamada et al., "Hydrogenation by $CoMo/Al_2O_3$ Catalyst (Part 3) Effect of $H_2S$ on Hydrogenation of Monoaromatic Hydrocarbons" (1988), Sekiyu Gakkaishi, vol. 31, No. 2 pp. 118–123.

UCC (Shell) Hysomer Process Cusher May 1986 pp. 5–15; Handbook of Pet. Refin Process. Robert Myers.

*Primary Examiner*—Helane Myers

*Attorney, Agent, or Firm*—Alexander J. McKillop; Malcolm D. Keen; Jessica M. Sinnott

[57] ABSTRACT

Low sulfur gasoline of relatively high octane number is produced from a catalytically cracked, sulfur-containing naphtha and benzene-rich fraction by hydrodesulfurization in a first reaction zone and treatment over an acidic catalyst, preferably an intermediate pore size zeolite such as ZSM-5 in a second reaction zone to reduce the octane loss which takes place as a result of the hydrodesulfurization. The benzene-rich fraction can be cofed to the first reaction zone or the second reaction zone. The benzene-rich fraction is preferably a heart-cut reformate.

37 Claims, 2 Drawing Sheets

GASOLINE UPGRADING PROCESS

CROSS REFERENCE TO RELATED APPLICATIONS

This application is a continuation-in-part of Ser. No. 07/961,592, filed on Oct. 15, 1992, now abandoned which is a continuation-in-part of our prior application Ser. No. 07/850,106, filed on Mar. 12, 1992, pending which, in turn, is a continuation-in-part of our prior application Ser. No. 07/745,311, filed Aug. 15, 1991, pending all incorporated herein by reference in their entireties.

FIELD OF THE INVENTION

This invention relates to a process for the upgrading of hydrocarbon streams. It more particularly refers to a process for upgrading gasoline boiling range petroleum fractions containing substantial proportions of sulfur impurities. Even more particularly, the invention relates to coprocessing a benzene-rich fraction to achieve a reduction in benzene and octane benefits.

BACKGROUND OF THE INVENTION

Catalytically cracked gasoline forms a major part of the gasoline product pool in the United States. However, where the petroleum fraction being catalytically cracked contains sulfur, the products of catalytic cracking usually contain sulfur impurities which normally require removal, usually by hydrotreating, in order to comply with the relevant product specifications. These specifications are expected to become more stringent in the future, possibly permitting no more than about 50 ppmw sulfur in motor gasolines; low sulfur levels also result in reduced emissions of CO, $NO_x$ and hydrocarbons. In the hydrotreating of petroleum fractions, particularly naphthas, and most particularly heavy cracked gasoline, the molecules containing the sulfur atoms are mildly hydrocracked so as to release their sulfur, usually as hydrogen sulfide.

In naphtha hydrotreating, the naphtha is contacted with a suitable hydrotreating catalyst at elevated temperature and somewhat elevated pressure in the presence of a hydrogen atmosphere. One suitable family of catalysts which has been widely used for this service is a combination of a Group VIII and a Group VI element, such as cobalt and molybdenum, on a suitable substrate, such as alumina. After the hydrotreating operation is complete, the product may be fractionated, or even just flashed, to release the hydrogen sulfide and collect the now sweetened gasoline. Although this is an effective process that has been practiced on gasolines and heavier petroleum fractions for many years to produce satisfactory products, it does have disadvantages.

Cracked naphtha, as it comes from the catalytic cracker and without any further treatments, such as purifying operations, has a relatively high octane number as a result of the presence of olefinic components. It also has an excellent volumetric yield. As such, cracked gasoline is an excellent contributor to the gasoline pool. It contributes a large quantity of product at a high blending octane number. In some cases, this fraction may contribute as much as up to half the gasoline in the refinery pool.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation. It is known that hydrotreating monoaromatic compounds results in ring saturation as described in Yamada et al, "Hydrogenation by $CoMo/Al_2O_3$ Catalyst (Part 3) Effect of $H_2S$ on Hydrogenation of Monoaromatic Hydrocarbons"; Vol. 31, No. 2 Sekiyu Gakkaishi, pp. 118–124 (1988).

Sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

Various proposals have been made for removing sulfur while retaining the more desirable olefins. U.S. Pat. No. 4,049,542 (Gibson), for instance, discloses a process in which a copper catalyst is used to desulfurize an olefinic hydrocarbon feed such as catalytically cracked light naphtha.

In any case, regardless of the mechanism by which it happens, the decrease in octane which takes place as a consequence of sulfur removal by hydrotreating creates a conflict between the growing need to produce gasoline fuels with higher octane number and—because of current environmental considerations—the need to produce cleaner burning, less polluting fuels, especially low sulfur fuels. This inherent tension is yet more marked in the current supply situation for low sulfur, sweet crudes.

Processes for treating catalytically cracked gasolines have been proposed in the past. For example, U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

We have demonstrated in our prior co-pending applications Ser. No. 07/850,106, filed on Mar. 12, 1992 pending and Ser. No. 07/745,311 filed on Aug. 15, 1991 that zeolite ZSM-5 is effective for restoring the octane loss which takes place when the initial naphtha feed is hydrotreated. When the hydrotreated naphtha is passed over the catalyst in the octane restoration step of the process, some components of the gasoline are cracked into lower boiling range materials, if these boil below the gasoline boiling range, there will be a loss in the yield of the gasoline product. If, however, the cracking products are within the gasoline range, a net volumetric yield increase occurs. To achieve this, it is helpful to increase the end point of the naphtha feed to the extent that this will not exceed the gasoline product end point or similar restrictions (i.e. $T_{90}$, $T_{95}$).

To increase their octane numbers, naphthas, including light and full range naphthas, may be subjected to catalytic reforming to convert at least a portion of the paraffins and cycloparaffins in them to aromatics. Fractions to be fed to catalytic reforming, such as over a platinum type catalyst, also need to be desulfurized before reforming because reforming catalysts are generally not sulfur tolerant. Therefore, naphthas are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Catalytic reforming of naphtha boiling range feeds to produce high octane reformate is a very successful refinery process, it converts the low octane naphthas to high octane, aromatics-rich gasoline by dehydrogenating and dehydroisomerizing aromatics as well as converting paraffins to ring compounds and subsequently dehydrogenating them to form aromatics. However, a problem with reforming is the large proportion of product aromatics, including benzene, which have been subject to severe limitations as gasoline components because of possible adverse effects on the ecology. Also, the octane number of the reformate produced can vary significantly with boiling range. For example, heart-cut reformate; that is, the $C_6$ fraction is composed of benzene, isoparaffins and normal hexane which has a lower octane than desired, i.e. lower than the octane number of the $C_7+$ fraction, mostly due to the normal hexane. The benzene content coupled with the low octane number of the $C_6$ fraction is troubling to many refiners.

SUMMARY OF THE INVENTION

We have now developed a process for improving the gasoline properties of a benzene-rich fraction and catalytically desulfurizing cracked fractions in the gasoline boiling range which restores the octane number of the feed and enables the sulfur to be reduced to acceptable levels. In favorable cases, the number of octane barrels of product produced is at least equivalent to the number of octane barrels of feed introduced into the operation because the process creates a balance between octane and yield.

The process may be utilized to treat a benzene-rich fraction which is separated from a reformate product. In this manner, the process is useful for reducing the overall aromatics potentially or actually produced in the reformer. The process may also be utilized to desulfurize light and full range naphtha fractions and to reduce, or recover, the octane loss by hydrotreating. This process obviates the need for reforming some of the naphtha fractions and lessens the degree of reforming previously considered necessary. Since reforming generally implies a significant yield loss, this constitutes a marked advantage.

According to the present invention, a sulfur-containing cracked petroleum fraction in the gasoline boiling range is hydrotreated under conditions which remove at least a substantial proportion of the sulfur.

For purposes of this invention, the term "hydrotreating" is used as a general process term descriptive of the reactions in which a prevailing degree of hydrodesulfurization occurs.

The octane of the hydrotreated intermediate product is increased and the benzenes in the $C_6$ fraction are reduced by treatment over a catalyst of acidic functionality under conditions which convert feed to a higher octane value fraction in the gasoline boiling range.

The invention is directed to a process of upgrading a sulfur-containing feed fraction boiling in the gasoline boiling range and a benzene-rich fraction which comprises:

contacting the sulfur-containing feed fraction with a hydrodesulfurization catalyst in a hydrodesulfurization reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in an octane restoration reaction zone with a catalyst of acidic functionality; and introducing the benzene-rich fraction to the hydrodesulfurization zone and/or the octane restoration reaction zone to produce a product comprising a fraction boiling in the gasoline boiling range having a higher octane number than the gasoline boiling range fraction of the intermediate product.

DETAILED DESCRIPTION

Feed

Figure 1:
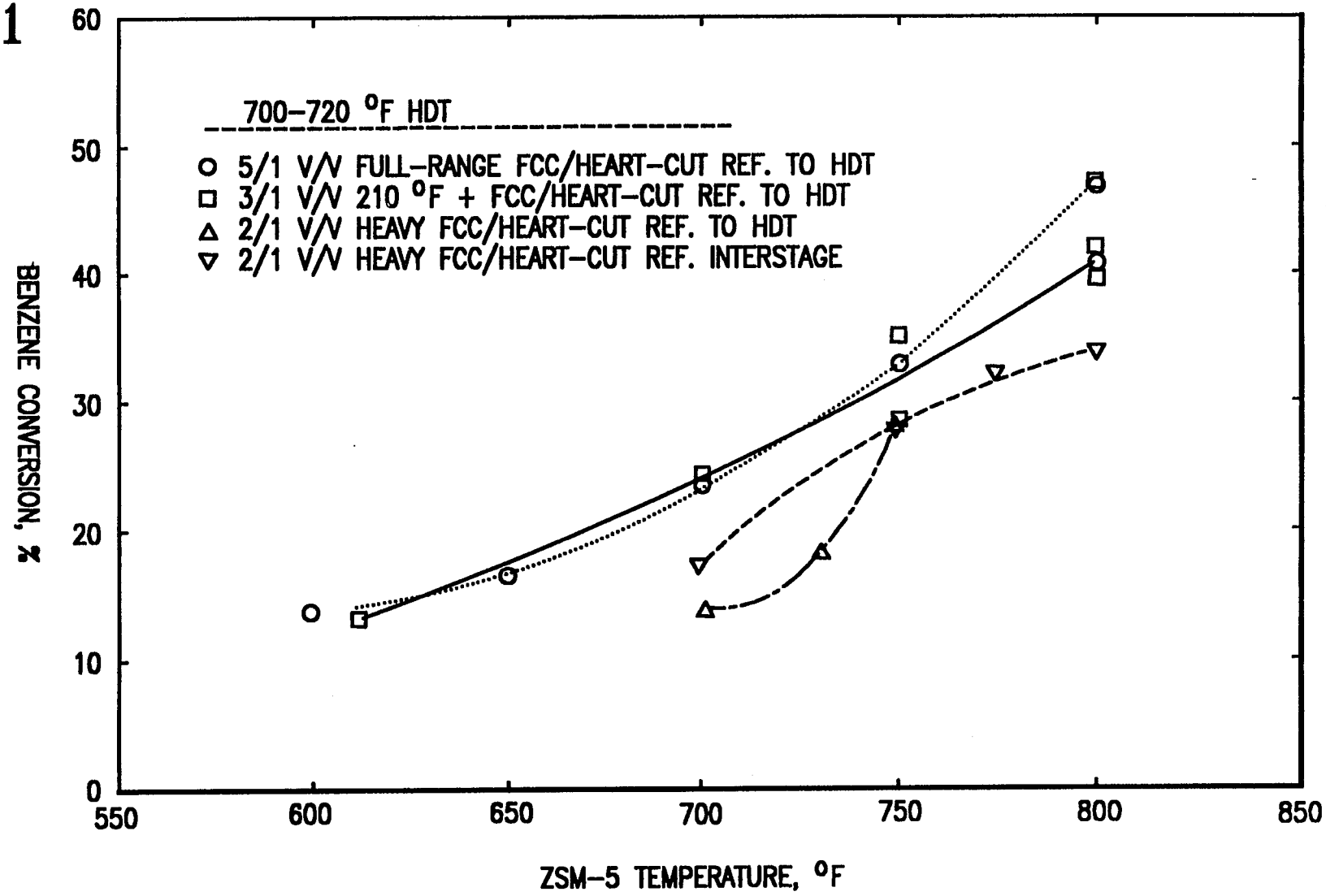
FIG. 1 is a plot of % benzene conversion v. temperature.

The feed to the process comprises a sulfur-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F.(163° C.) and preferably at least about 350° F.(177° C.), for example, 95 percent points of at least 380° F. (about 193° C.) or at least about 400° F. (about 204° C.).

Because the sulfur tends to be concentrated in the higher boiling fractions, (and olefins in lighter fractions) it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F.(93° C.) to about 300° F.(150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F.(65° C.) is mostly in the form of mercaptans which may be removed by extractive type processes such as Merox but hydrotreating is appropriate for the removal of thiophenes and other cyclic sulfur compounds present in higher boiling components e.g. component fractions boiling above about 180° F.(82° C.). Treatment of the lower boiling fraction in an extractive type process coupled with hydrotreating of the higher boiling component may therefore represent a preferred economic process option. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F.(193° C.), the sulfur content may exceed about 1,000 ppmw and may be as high as 4,000 or 5,000 ppmw or even higher. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent.

Cofeed

A cofeed to the process comprises a relatively high aromatic fraction. This feed is specifically a benzene-rich feed which typically contains at least about 5 vol. % benzene, more specifically about 20 vol. % to 60 vol. % benzene. A specific refinery source for the fraction is a fraction from the reformer. The fraction contains smaller amounts of lighter hydrocarbons, typically less than about 10% $C_5$ and lower hydrocarbons and small amounts of heavier hydrocarbons, typically less than about 15% $C_7$+ hydrocarbons. These feeds usually contain very low amounts of sulfur as, usually, they have been subjected to desulfurization prior to reforming.

Examples include a reformate from a fixed bed, swing bed or moving bed reformer. The most useful reformate is a heart-cut reformate. This is preferably reformate having a narrow boiling range, i.e. a $C_6$ or $C_6/C_7$ fraction. This fraction is a complex mixture of hydrocarbons recovered as the overhead of a dehexanizer column downstream from a depentanizer column. The composition will vary over a wide range, depending upon a number of factors including the severity of operation in the reformer and reformer feed. These streams will usually have the $C_5$'s, $C_4$'s and lower hydrocarbons removed in the depentanizer and debutanizer. Therefore, usually, the heart-cut reformate will contain at least 70 wt. % $C_6$ hydrocarbons, and preferably at least 90 wt. % $C_6$ hydrocarbons. Other sources of a benzene-rich feed include a light naphtha, coker naphtha or pyrolysis gasoline.

By boiling range, these benzene-rich fractions can be defined by an end boiling point of about 250° F., and preferably no higher than about 230° F. Preferably, the boiling range falls between 100° F. and 212° F., and more preferably between the range of 150° F. to 200° F. and even more preferably within the range of 160° F. to 200° F.

The following Table A sets forth the properties of a useful $C_6$–$C_7$ heart-cut reformate that boils below about 250° F.

TABLE A

| $C_6$–$C_7$ Heart-Cut Reformate | |
|---|---|
| RON | 82.6 |
| MON | 77.3 |
| Composition, wt. % | |
| $iC_5$ | 0.9 |
| $nC_5$ | 1.3 |
| $C_5$ Naph | 1.5 |
| $iC_6$ | 22.6 |
| $nC_6$ | 11.2 |
| $C_6$ Naph | 1.1 |
| Benzene | 32.0 |
| $iC_7$ | 8.4 |
| $nC_7$ | 2.1 |
| $C_7$ Naph | 0.4 |
| Toluene | 17.7 |
| $iC_8$ | 0.4 |
| $nC_8$ | 0.0 |
| $C_8$ Arom. | 0.4 |

Table B sets forth the properties of a more preferred benzene-rich heart-cut fraction which is more paraffinic.

TABLE B

| Benzene-Rich Heart-Cut Reformate | |
|---|---|
| RON | 78.5 |
| MON | 74.0 |
| Composition, wt. % | |
| $iC_5$ | 1.0 |
| $nC_5$ | 1.6 |
| $C_5$ Naph | 1.8 |
| $iC_6$ | 28.6 |
| $nC_6$ | 14.4 |
| $C_6$ Naph | 1.4 |
| Benzene | 39.3 |
| $iC_7$ | 8.5 |
| $nC_7$ | 0.9 |
| $C_7$ Naph | 0.3 |
| Toluene | 2.3 |

Hydrotreating

The temperature of the hydrotreating step is suitably maintained from about 400° to 850° F. (about 204° to 454° C.), preferably about 500° to 800° F. (about 260° to 427° C.) with the exact selection dependent on the desulfurization desired for a given feed and catalyst. Because the hydrogenation reactions which take place in this step are exothermic, a rise in temperature takes place along the reactor; this is actually favorable to the overall process when it is operated in the cascade mode because the octane restoration step is one which implicates cracking, an endothermic reaction. In this case, therefore, the conditions in the hydrodesulfurization step should be adjusted not only to obtain the desired degree of desulfurization but also to produce the required inlet temperature for the octane restoration step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the octane restoration step of the reaction. When operated with interstage separation and heating, control of the exotherm of hydrodesulfurization is obviously not as critical. Operation with interstage separation and heat may be preferred since it offers the capability of decoupling and optimizing the temperature requirements of the individual stages.

Since the naphtha feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the octane restoration step of the process.

Normally, the denitrogenation which accompanies the desulfurization will result in an acceptable organic nitrogen content in the feed to the subsequent steps of the process; if it is necessary, however, to increase the denitrogenation in order to obtain a desired level of activity in the subsequent step, the operating conditions in the hydrodesulfurization step may be adjusted accordingly. Addition of reformate to the first stage may decrease residence time to the point where in order to maintain desulfurization and denitrogenization at acceptable levels an increase in hydrotreater severity may be required, e.g. by increasing the reactor temperature.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, such as: a down-flow, liquid phase, fixed bed process; an upflow, fixed bed, trickle phase process; an ebullating, fluidized bed process; or a transport, fluidized bed process. All of these different process schemes are generally well known in the petroleum arts, and the choice of the particular mode of operation is a matter left to the discretion of the operator, although the fixed bed arrangements are preferred for simplicity of operation.

Hydrotreating the benzene-rich fraction along with the naphtha feed achieves saturation of aromatics resulting in a final or intermediate product of lower benzene content than the feed. This saturation increases the overall level of benzene conversion possible in the process.

Octane Restoration

The hydrotreated intermediate product is passed to the octane restoration step of the process in which cracking, aromatic alkylation and dealkylation takes place over a catalyst of acidic functionality and in the presence of a benzene-rich feed which is either introduced at this step, or which was introduced at the desulfurization step.

Conversion of benzene by alkylation increases the octane of the final product by formation of higher octane alkylbenzenes and reduces the benzene content of the feed.

The amount of the benzene-rich feed which can be co-fed to the process can vary greatly depending upon the amount of benzene removal and octane boost needed, and the capacity of the reactor and downstream equipment. The benzene-rich feed will usually be added, relative to the intermediate product feed, in a range of from about 1 to about 50 wt. %, preferably from about 10 to about 40 wt. %, more preferably from about 15 wt. % to about 30 wt. % and even more preferably from about 20 wt. % to about 25 wt. %.

In one embodiment of the invention which integrates this process with reforming, a very advantageous source of the feed to the reformer can come, at least in part, from the hydrodesulfurization zone of this process. That is, a heart cut from the naphtha fraction, for example, a 195°-302° F. (90°-150° C.) fraction, from the hydrodesulfurization product may be sent to the reformer where the low octane naphthenes which make up a significant portion of this fraction are converted to high octane aromatics. The heart-cut, $C_6$ fraction is separated from the reformate and sent to the octane restoration step for treatment with the acid catalyst. This may, however, require more severe hydrotreating of the feed to meet the lower sulfur and nitrogen specifications required for reformer feeds (i.e., sulfur of about 0.5 ppm and nitrogen of about 0.5 ppm). Thus, the preferred configuration in this alternative is for the octane restoration step to process the $C_6$+, or 302° F.+, portion of the desulfurized effluent. This offers appropriate and efficient integration of the refinery processes of reforming with the hydrodesulfurization and octane restoration of this process. In this embodiment, the severity of the hydrodesulfurization step will, typically, be sufficient to achieve about 0.5 ppm sulfur and nitrogen in the product. Improvements in both octane and yield can be expected.

In another embodiment of this invention the benzene-rich feed is heated to a temperature of at least about 50° F. higher than the intermediate of the hydrotreeating before it is transferred to the octane restoration step. The heated reformate can supply sufficient heat to the intermediate to provide the heat necessary for the octane restoring reactions.

The effluent from the hydrotreating step may be subjected to an interstage separation in order to remove the inorganic sulfur and nitrogen as hydrogen sulfide and ammonia as well as light ends but this is not necessary and, in fact, it has been found that the effluent of the hydrodesulfurization step can be cascaded directly into the octane restoration step. This can be done very conveniently in a down-flow, fixed-bed reactor by loading the hydrotreating catalyst directly on top of the octane restoration catalyst bed.

The separation of the light ends at the point prior to octane restoration is desirable if the added complication is acceptable since the saturated $C_4$-fraction from the hydrotreater is a highly suitable feed to be sent to the alkylation unit for conversion to isoparaffinic materials of high octane rating; this will also reduce the quantity of any non-gasoline ($C_5-$) components in the octane restored product.

The conditions used in the octane restoration step of the process are those which result in a controlled degree of shape-selective cracking of the desulfurized, hydrotreated effluent to remove paraffins which restores the octane rating of the original, cracked feed at least to a partial degree.

The reactions which take place include the shape-selective cracking of low octane paraffins to form higher octane products, both by the selective cracking of heavy paraffins to lighter paraffins and the cracking of low octane n-paraffins, in both cases with the generation of olefins. A substantial degree of isomerization of n-paraffins to branched-chain paraffins of higher octane may take place, making a further contribution to the octane of the final product. Aromatics alkylation and transalkylation reactions converting benzene to other aromatics may also occur. Other reactions which take place are less selective and effectuate cracking of bulkier, more highly branched paraffins, olefins and cyclics to lighter products useable as high octane gasoline.

In favorable cases, the original octane rating of the naphtha feed may be completely restored or perhaps even exceeded with a meaningful boost in the octane rating of the reformate fraction. Since the volume of the octane restored product will typically be comparable to that of the original feed or even exceed it, the number of octane barrels (octane rating x volume) of the final, desulfurized product may exceed the octane barrels of the feed.

The conditions used in the octane restoration step are those which are appropriate to produce this controlled degree of cracking. Typically, the temperature of the octane restoration step will be about 300° to 900° F. (about 150° to 480° C.), preferably about 350° to 800° F. (about 177° C.). As mentioned above, in one embodiment, a convenient mode of operation is cascading the hydrotreated effluent into the octane restoration zone and this implies that the outlet temperature from the hydrodesulfurization zone will set the initial temperature for the octane restoration zone. When cascading from the hydrodesulfurization zone, the feed characteristics and the inlet temperature of the hydrotreating zone, coupled with the conditions used in the hydrodesulfurization step will set the hydrodesulfurization exotherm and, therefore, the initial temperature of the octane restoration. Thus, the process can be operated in a completely integrated manner, as shown below.

The pressure in the octane restoration reaction zone is not critical since hydrogenation is not desired at this point in the sequence although a lower pressure in this step will tend to favor olefin production with a consequent favorable effect on product octane. The pressure will therefore depend mostly on operating convenience and will typically be comparable to that used in the hydrodesulfurization step (or alkylation step), particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen to hydrocarbon ratios typically of about 0 to 5000 SCF/Bbl (0 to 890 $n.l.l^{-1}$.), preferably about 100 to 2500 SCF/Bbl (about 18 to 445 $n.l.l^{-1}$.) will be selected to minimize catalyst aging.

The use of relatively lower hydrogen pressures can thermodynamically favor the increase in volume which occurs in the octane restoration step and for this reason, overall lower pressures may be preferred if this can be accommodated by the constraints on the aging of the two catalysts. In the cascade mode, the pressure may be constrained by the requirements of the previous step. However, the possibility of recompression in the interstage separation mode permits the pressure requirements to be individually selected, affording the potential for optimizing conditions in each step.

Consistent with the objective of restoring lost octane while retaining overall product volume, the conversion to products boiling below the gasoline boiling range ($C_5-$) during the octane restoration step is held to a minimum. However, because the cracking of the heavier portions of the feed may lead to the production of products still within the gasoline range a net increase in $C_5+$ material may occur during this step of the process, particularly if the feed includes significant amounts of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

Octane Restoration Catalyst

The octane restoration step of the process comprises a catalyst of sufficient acidic functionality to bring about the desired cracking reactions to restore the octane lost in the hydrotreating step.

One measure of the acid activity of a catalyst is its alpha number. This is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in J. Catalysis, 4, 527 (1965); 6, 278 (1966); and 61, 395 (1980), to which reference is made for a description of the test. The experimental conditions of the test used to determine the alpha values referred to in this specification include a constant temperature of 538° C. and a variable flow rate as described in detail in J. Catalysis, 61, 395 (1980).

The catalyst used in the octane restoration step of the process suitably has an alpha activity of at least about 20, usually in the range of 20 to 800 and preferably at least about 50 to 200. Even higher alpha activity catalysts can be used, although it may not be appropriate for this catalyst to have too high an acid activity because it is desirable to only crack and rearrange so much of the intermediate product as is necessary to restore lost octane without severely reducing the volume of the gasoline boiling range product.

Consistent with the objective of restoring lost octane while retaining overall product volume, the conversion to products boiling below the gasoline boiling range ($C_5-$) during the octane restoration stage is held to a minimum. However, because the cracking of the heavier portions of the feed may lead to the production of products still within the gasoline range, no net conversion to $C_5-$products may take place and, in fact, a net increase in C5+material may occur during this stage of the process, particularly if the feed includes a significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the octane restoration step of the process possesses sufficient acidic functionality to bring about the desired cracking reactions to restore the octane lost in the hydrotreating step. The preferred catalysts for this purpose are the intermediate pore size zeolitic behaving catalytic materials which are exemplified by those acid acting materials having the topology of intermediate pore size aluminosilicate zeolites. These zeolitic catalyst materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-22, ZSM-23, ZSM-35, ZSM-48, ZSM-50 or MCM-22. Zeolite MCM-22 is described in U.S. Pat. No. 4,954,325 and 4,962,256. Other catalytic materials having the appropriate acidic functionality may, however, be employed. A particular class of catalytic materials which may be used are, for example, the large pore size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina, titania and zirconia.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable because it may tend to promote saturation of olefinics produced in the cracking reactions. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the octane restoration conversion catalyst will usually be determined by the type of conversion process which is being carried out, such as: a down-flow, liquid phase, fixed bed process; an up-flow, fixed bed, liquid phase process; an ebulating, fixed fluidized bed liquid or gas phase process; or a liquid or gas phase, transport, fluidized bed process, as noted above, with the fixed-bed type of operation preferred.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers and is higher than the octane of the feed, by more than about 0 to 5 octane numbers, preferably about 0 to 1 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the hydrodesulfurization and octane restoration steps may be the same or different but the exotherm from the hydrotreatment step and will normally result in a higher initial temperature for the octane restoration step. Where there are distinct conversion zones, whether in cascade operation or otherwise, it is often desirable to operate the zones under different conditions. Thus, the octane restoration zone may be operated at higher temperature and lower pressure than the hydrodesulfurization in order to maximize the octane increase obtained in this zone.

Further increases in the volumetric yield of the gasoline boiling range fraction of the product, and possibly also of the octane number (particularly the motor octane number), may be obtained by using the $C_3$–$C_4$ portion of the product as feed for an alkylation process to produce alkylate of high octane number. The light ends from the octane restoration step are particularly suitable for this purpose since they are more olefinic than the comparable but saturated fraction from the hydrotreating step.

In one example of the operation of this process, it is reasonable to expect that, with a heavy cracked naphtha feed, the hydrodesulfurization will reduce the octane number by at least 1.5%, more normally at least about 3%. With a full range naphtha feed, it is reasonable to expect that the hydrodesulfurization operation will reduce the octane number of the gasoline boiling range fraction of the hydrodesulfurization intermediate product by at least about 5%, and, if the sulfur content is high in the feed, that this octane reduction could go as high as about 15%.

The octane restoration step of the process should be operated under a combination of conditions such that at least about half (½) of the octane lost during hydrodesulfurization operation will be recovered, preferably such that all of the lost octane will be recovered, most preferably that the octane restoration stage will be operated such that there is a net gain of at least about 1% in octane over that of the feed, which is about equivalent to a gain of about at least about 5% based on the octane of the hydrotreated intermediate.

The process should normally be operated under a combination of conditions such that the desulfurization should be at least about 50%, preferably at least about 75%, as compared to the sulfur content of the feed.

As mentioned previously, the benzene-rich feed can be introduced at any stage; that is, it can be cofed to the hydrodesulfurization stage and passed along with the intermediate product to the second stage or it can be introduced to the second stage.

It has been found that cofeeding a benzene-rich stream, particularly a heart-cut reformate increases the gasoline pool octane-barrels which is a considerable improvement over treating a naphtha fraction alone.

EXAMPLES

In these examples each of the following FCC naphtha fractions was subjected to hydrotreating and octane restoration.

TABLE 1

FCC Naphtha Feed Properties

| FCC Stream | Full-Range Naphtha | 210° F.+ Naphtha | Heavy Naphtha |
|---|---|---|---|
| Research Octane (A313) | 93.3 | 93.0 | 96.4 |
| Motor Octane (A314) | 81.1 | 81.5 | 84.0 |
| Road Octane, (R + M)/2 | 87.2 | 87.3 | 90.2 |
| API | 46.3 | 41.1 | 22.8 |
| Bromine Number (D1159) | 59.9 | 37.1 | 10.4 |
| Sulfur, wt. % | 0.13, 0.09 | 0.20 | 1.90 |
| Nitrogen, ppmw | 59, 44 | 98 | 180 |
| Composition, wt. % (Approx) | | | |
| $C_4$–$C_{12}$ n-paraffins | 4.3 | 2.9 | 0.1 |
| $C_4$–$C_{11}$ iso-paraffins | 15.7 | 9.5 | 1.8 |
| $C_5$–$C_{12}$ naphthenes | 7.9 | 7.7 | 0.7 |
| Dicycloparaffins | 0.9 | 1.2 | 0.1 |
| $C_4$–$C_{11}$ n-olefins | 8.4 | 2.7 | 0.0 |
| $C_4$–$C_{10}$ iso-olefins | 15.7 | 8.9 | 0.4 |
| $C_5$–$C_{12}$ cyclic olefins | 5.9 | 4.8 | 0.1 |
| Heavy Olefins | 0.6 | 0.9 | 0.1 |
| Benzothiophenes | 0.6 | 0.7 | 8.3 |

TABLE 1-continued

FCC Naphtha Feed Properties

| FCC Stream | Full-Range Naphtha | 210° F.+ Naphtha | Heavy Naphtha |
|---|---|---|---|
| Benzene | 0.9 | 0.2 | 0.1 |
| $C_7$–$C_{10}$ Alkylbenzenes | 27.9 | 43.7 | 11.7 |
| $>C_{11}$ paraffins, naphthenes | 3.4 | 4.1 | 11.9 |
| Naphthalenes | 0.9 | 1.5 | 27.1 |
| Indanes, Tetralins | 3.6 | 5.8 | 15.3 |
| Other Heavy aroms | 3.3 | 5.6 | 22.5 |
| Distillation (D86). °F. | | | |
| 5/10 vol. % | 134/146 | 256/261 | 382/394 |
| 20/40 vol % | 165/209 | 269/289 | 408/427 |
| 60/80 vol % | 265/325 | 318/352 | 443/462 |
| 90/95 vol % | 357/377 | 373/387 | 476/488 |

A heart-cut reformate having the properties defined below in Table 2 was blended with each of the above naphtha fractions.

TABLE 2

Heart-Cut Reformate Properties

| | |
|---|---|
| Research Octane (A313) | 78.5 |
| Motor Octane (A314) | 73.8 |
| Road Octane (R + M)/2 | 76.2 |
| Bromine Number | 5.2 |
| Composition, wt. % | |
| Isopentane | 1.0 |
| N-Pentane | 1.6 |
| Cyclopentane | 1.8 |
| Benzene | 39.3 |
| $C_6$ Isoparaffins | 28.6 |
| N-Hexane | 14.4 |
| $C_6$ Naphthenes | 1.4 |
| Toluene | 2.3 |
| $C_7$ Isoparaffins | 8.5 |
| N-Heptane | 0.9 |
| $C_7$ Naphthenes | 0.3 |

Each of the naphtha fractions was blended with the reformate and the properties of each blend are described below in Table 3.

TABLE 3

FCC Naphtha/Heart-Cut Reformate Blend Properties

| FCC Stream | Full-Range Naphtha | 210° F.+ Naphtha | Heavy Naphtha | Heavy Naphtha |
|---|---|---|---|---|
| FCC/Reformate, vol/vol | 5/1 | 3/1 | 2/1 | 2/1[a] |
| Research Octane | 91.9 | 90.9 | 91.2 | 90.6 |
| Motor Octane | 80.5 | 80.6 | 80.8 | 80.3 |
| Road Octane | 86.2 | 85.8 | 86.0 | 85.5 |
| API | 56.4 | 45.7 | 32.9 | 33.0 |
| Bromine Number | 56.1 | 36.3 | 12.7 | |
| Sulfur, wt. % | 0.11 | 0.14 | 1.50 | 1.55 |
| Nitrogen, ppmw | 47 | 71 | 130 | 130 |
| Benzene, wt. % | 8.3 | 9.2 | 10.4 | 10.0 |
| Distillation, °F. | | | | |
| 5 vol. % | 135 | 190 | 166 | 161 |
| 10 vol. % | 143 | 199 | 177 | 174 |
| 30 vol. % | 166 | 230 | 258 | 239 |
| 50 vol. % | 197 | 276 | 418 | 414 |
| 70 vol. % | 258 | 318 | 441 | 435 |
| 90 vol. % | 345 | 366 | 469 | 464 |
| 95 vol. % | 368 | 382 | 494 | 481 |
| Heart-Cut Reformate Blending Octanes | | | | |
| Research | 84.9 | 84.6 | 80.8 | |
| Motor | 77.5 | 77.9 | 74.4 | |
| Road | 81.2 | 81.3 | 77.6 | |

[a]Reformate was slightly lower in benzene content.

Each feed fraction was subjected to hydrotreating over a CoMo hydrotreating catalyst followed by treatment over acidic H-ZSM-5 having an alpha value of about 110. Conditions in each of the stages are as follows, points of introduction of the reformate are indicated.

Example 1

The following Tables 5 and 6 compare the results of treating the naphtha fractions with the results of cofeeding a benzene-rich reformate under the conditions recited in Table 4.

TABLE 4

| Run Conditions | |
|---|---|
| Conditions | Full-Range Naphtha |
| Reformate Feed Point | First stage |
| $H_2$ Circulation, scfb | ~1050# |
| Pressure, psig | 600 |
| Temperature, °F., | |
| first stage | 700 |
| Second stage | 400–800 |
| LHSV, $hr^{-1}$, | |
| first stage | 2.0 |
| Second stage | 1.0 |

TABLE 5

| Full-Range Naphtha | | | | |
|---|---|---|---|---|
| Days on stream (first stage) | 20.5 | 21.6 | 22.8 | 24.4 |
| Days on stream (second stage) | 32.0 | 33.1 | 34.3 | 35.9 |
| LHSV (overall), $hr^{-1}$ | 0.67 | 0.67 | 0.56 | 0.56 |

TABLE 5-continued

| Full-Range Naphtha | | | | |
|---|---|---|---|---|
| $H_2$ Feed, scfb | ~1050 | ~1050 | ~1050 | ~1050 |
| Pressure, psig | 590 | 590 | 590 | 590 |
| Temperature °F. (first stage) | 695 | 695 | 700 | 700 |
| Temperature °F. (second stage) | 750 | 800 | 750 | 800 |
| $C_5$+ Yield, vol. % | 100.6 | 84.2 | 93.4 | 88.5 |
| $C_5$+ Road Octane-Feed | −5.8 | −3.4 | −6.0 | −4.5 |
| $C_5$+ Road Octane | 81.4 | 83.8 | 81.2 | 82.7 |
| Benzene, wt. % in $C_5$+ | 1.1 | 1.5 | 1.1 | 1.4 |

TABLE 6

| 5:1 v/v Full-Range Naptha/Heart-Cut Reformate | | | | | | | |
|---|---|---|---|---|---|---|---|
| Days on stream (first stage) | 11.4 | 13.5 | 14.6 | 15.8 | 17.5 | 39.5 | 41.5 |
| Days on stream (second stage) | 22.9 | 25.0 | 26.1 | 27.3 | 29.0 | 51.0 | 53.0 |
| LHSV (overall), $hr^{-1}$ | 0.67 | 0.67 | 0.67 | 0.66 | 0.66 | 0.67 | 0.67 |
| $H_2$ Feed, scfb | ~1050 | ~1050 | ~1050 | ~1050 | ~1050 | ~1050 | ~1050 |
| Pressure, psig | 590 | 590 | 590 | 590 | 590 | 590 | 590 |
| Temperature °F. (first stage) | 696 | 696 | 696 | 696 | 695 | 700 | 700 |
| Temperature °F. (second stage) | 397 | 598 | 649 | 699 | 750 | 800 | 800 |
| $C_5$+ Yield, vol. % | 99.8 | 100.3 | 100.5 | 98.3 | 94.4 | 83.6 | 83.4 |
| $C_5$+ Road Octane-Feed | −8.6 | −8.3 | −8.4 | −7.0 | −3.6 | −2.1 | −2.2 |
| $C_5$+ Road Octane | 77.6 | 77.9 | 77.8 | 79.2 | 82.6 | 84.1 | 84.0 |
| Benzene, wt. % in $C_5$+ | 7.3 | 7.2 | 7.0 | 6.6 | 5.9 | 5.1 | 5.1 |
| Benzene Conversion, % | 12.6 | 13.7 | 16.4 | 23.3 | 32.8 | 46.8 | 46.4 |
| n-hexane + n hexene conv., % | — | 9.4 | — | 15.7 | 35.6 | 59.4 | 58.3 |

Example 2

Tables 8 and 9 compare the results of treating a 210° F.+ naphtha with the results of treating the same naphtha along with a benzene-rich reformate cofeed under the conditions described in Table 7.

TABLE 7

| Run Conditions | |
|---|---|
| Conditions | 210° F.+ Naphtha |
| Reformate Feed Point | First Stage |
| $H_2$ Circulation, scfb | ~1050 |
| Pressure, psig | 600 |
| Temperature, °F., | |
| first stage | 700 |
| Second stage | 400–800 |
| LHSV, $hr^{-1}$ | |
| first stage | 2.0 |
| Second stage | 1.0 |

TABLE 8

| 210° F.+ Naphtha | | | | | | | | |
|---|---|---|---|---|---|---|---|---|
| Days on stream (first stage) | 154.3 | 2.1 | 5.1 | 6.6 | 8.1 | 10.6 | 17.2 | 18.7 |
| Days on stream (second stage) | 154.3 | 2.1 | 5.1 | 6.6 | 8.1 | 10.6 | 17.2 | 18.7 |
| LHSV (overall), $hr^{-1}$ | 1.18 | 1.17 | 1.17 | 1.17 | 1.17 | 1.16 | 1.17 | 1.17 |
| $H_2$ Feed, scfb | 2280 | 2150 | 2160 | 2170 | 2170 | 2140 | 2190 | 2150 |
| Pressure, psig | 600 | 600 | 600 | 600 | 600 | 600 | 600 | 590 |
| Temperature °F. (first stage) | 749 | 653 | 751 | 700 | 698 | 751 | 650 | 651 |
| Temperature °F. (second stage) | 779 | 681 | 780 | 729 | 350 | 350 | 348 | 678 |
| $C_5$+ Yield, vol. % | 96.2 | 98.8 | 90.0 | 97.7 | 101.9 | 101.7 | 101.6 | 101.0 |
| $C_5$+ Road Octane-Feed | −2.0 | −9.0 | +1.8 | −5.9 | −10.8 | −10.5 | −10.3 | −9.4 |
| $C_5$+ Road Octane | 85.3 | 78.3 | 89.1 | 81.4 | 76.5 | 76.8 | 77.0 | 77.9 |
| Benzene, wt % | 0.8 | 0.4 | 1.1 | 0.5 | 0.2 | 0.2 | 0.1 | 0.3 |

TABLE 8-continued

| 210° F.+ Naphtha |
|---|
| in $C_5$+ |

TABLE 9

| 3:1 v/v 210° F.+ Naphtha/Heart-Cut Reformate | | | | | | | | |
|---|---|---|---|---|---|---|---|---|
| Days on stream (first stage) | 1.8 | 3.5 | 4.6 | 8.8 | 30.5 | 31.7 | 35.4 | 37.5 |
| Days on stream (second stage) | 13.3 | 15.0 | 16.1 | 20.3 | 42.0 | 43.2 | 46.9 | 49.0 |
| LHSV (overall), $hr^{-1}$ | 0.67 | 0.67 | 0.67 | 0.67 | 0.67 | 0.67 | 0.67 | 0.67 |
| $H_2$ Feed, scfb | ~1050 | ~1050 | ~1050 | ~1050 | ~1050 | ~1050 | ~1050 | ~1050 |
| Pressure, psig | 590 | 590 | 590 | 590 | 590 | 590 | 590 | 590 |
| Temperature °F. (first stage) | 722 | 722 | 710 | 694 | 700 | 700 | 700 | 700 |
| Temperature °F. (second stage) | 400 | 599 | 700 | 751 | 750 | 800 | 800 | 800 |
| $C_5$+ Yield, vol. % | 101.5 | 101.8 | 101.0 | 95.0 | 98.1 | 90.6 | 92.0 | 89.7 |
| $C_5$+ Road Octane-Feed | −10.0 | −9.8 | −7.4 | −2.1 | −5.4 | −0.3 | +0.6 | +0.6 |
| $C_5$+ Road Octane | 75.8 | 76.0 | 78.4 | 83.7 | 80.4 | 85.5 | 86.4 | 86.4 |
| Benzene, wt % in $C_5$+ | 8.0 | 7.9 | 7.0 | 6.3 | 6.7 | 6.1 | 5.8 | 5.8 |
| Benzene Conversion, % | 12.0 | 13.2 | 24.1 | 34.9 | 28.2 | 39.4 | 41.2 | 41.5 |
| nhexane + nhexene conv., % | 13.2 | 7.5 | 16.7 | — | 23.1 | 48.7 | 52.4 | 53.2 |

Example 3

Tables 11 and 12 compare the results of treating a heavy naphtha with the results of treating the heavy naphtha along with a benzene-rich heart-cut reformate under the conditions set forth in Table 10.

TABLE 10

| Run Conditions | |
|---|---|
| Conditions | Heavy Naphtha |
| Reformate Feed Point | Interstage |
| $H_2$ Circulation, scfb | 2000 |
| Pressure, psig | 600 |
| Temperature, °F., | |
| first stage | 700 |
| Second stage | 400–750 |
| LHSV, $hr^{-1}$, | |
| first stage | 2.0 |
| Second stage | 1.0 |

TABLE 11

| Heavy Naphtha | | | | | | |
|---|---|---|---|---|---|---|
| Days on stream (first stage) | 33.2 | 34.7 | 36.2 | 37.7 | 90.7 | 93.7 |
| Days on stream (second stage) | 33.2 | 34.7 | 36.2 | 37.7 | 90.7 | 93.7 |
| LHSV (overall), $hr^{-1}$ | 0.63 | 0.63 | 0.65 | 0.64 | 0.64 | 0.64 |
| $H_2$ Feed, scfb | ~2000 | ~2000 | ~2000 | ~2000 | ~2000 | ~2000 |
| Pressure, psig | 600 | 610 | 600 | 600 | 600 | 600 |
| Temperature °F. (first stage) | 699 | 699 | 699 | 701 | 701 | 700 |
| Temperature °F. (second stage) | 749 | 702 | 651 | 610 | 449 | 699 |
| $C_5$+ Yield, vol. % | 98.9 | 100.0 | 101.7 | 102.2 | 102.7 | 100.7 |
| $C_5$+ Road Octane-Feed | +1.3 | −0.2 | −2.2 | −3.5 | −3.6 | +0.2 |
| $C_5$+ Road Octane | 87.2 | 88.4 | 91.1 | 92.2 | 93.0 | 93.3 |
| Benzene, wt % in $C_5$+ | 0.1 | 0.3 | 0.7 | 1.1 | 1.4 | 1.8 |

TABLE 12

| 2:1 v/v Heavy Naphtha/Heart-Cut Reformate | | | | |
|---|---|---|---|---|
| Days on stream (first stage) | 67 | 68 | 69 | 93 |
| Days on stream (second stage) | 67 | 68 | 69 | 93 |
| LHSV (overall), $hr^{-1}$ | 0.86 | 0.85 | 0.86 | 0.85 |

TABLE 12-continued

| 2:1 v/v Heavy Naphtha/Heart-Cut Reformate | | | | |
|---|---|---|---|---|
| $H_2$ Feed, scfb | 1400 | 1300 | 1300 | 1500 |
| Pressure, psig | 605 | 610 | 610 | 600 |
| Temperature °F. (first stage) | 701 | 701 | 701 | 700 |
| Temperature °F. (second stage) | 749 | 730 | 701 | 450 |
| $C_5$+ Yield, vol. % | 96.7 | 99.0 | 99.8 | 101.7 |
| $C_5$+ Road Octane | 90.4 | 88.8 | 88.0 | 84.0 |
| $C_5$+ Road Octane-Feed | +4.4 | +2.8 | +2.0 | −1.5 |
| Benzene, wt. % in $C_5$+ | 7.8 | 8.7 | 9.1 | 9.3 |
| Benzene Conversion, % | 27.9 | 18.1 | 13.8 | 7.4 |
| nHexane + nHexene Conv, % | 31.2 | 15.8 | 8.9 | 3.8 |

Example 4

Table 13 sets forth the results of treating the heavy naphtha with the benzene-rich heart-cut reformate as an interstage feed.

TABLE 13

| 2:1 v/v Heavy Naphtha/Heart-Cut Reformate Reformate Fed Interstage | | | | |
|---|---|---|---|---|
| Days on stream | 88 | 89 | 90 | 91 |

TABLE 13-continued

| 2:1 v/v Heavy Naphtha/Heart-Cut Reformate Reformate Fed Interstage | | | | |
|---|---|---|---|---|
| (first stage) | | | | |
| Days on stream | 88 | 89 | 90 | 91 |
| (second stage) | | | | |
| LHSV (overall), $hr^{-1}$ | 0.86 | 0.85 | 0.86 | 0.85 |
| $H_2$ Feed, scfb | ~2000 | ~2000 | ~2600 | ~2000 |
| Pressure, psig | 600 | 600 | 600 | 600 |
| Temperature °F. | 700 | 700 | 701 | 701 |
| (first stage) | | | | |
| Temperature °F. | 800 | 774 | 749 | 699 |
| (second stage) | | | | |
| $C_5$+ Yield, vol. % | 91.0 | 95.1 | 97.0 | 100.2 |
| $C_5$+ Road Octane | 91.9 | 90.1 | 89.1 | 86.3 |
| $C_5$+ Road Octane-Feed | +5.4 | +4.6 | +3.6 | +0.8 |
| Benzene, wt. % in $C_5$+ | 7.3 | 7.2 | 7.6 | 8.5 |
| Benzene Conversion, % | 33.7 | 32.0 | 27.6 | 16.9 |
| nHexane + nHexene Conv, % | 62.8 | 36.2 | 22.9 | 6.8 |

FIG. 1 is a plot of benzene conversion of each of the feeds used in the above examples v. temperature (° F) in the second stage of the process which was carried out over ZSM-5 based on the data of the examples with the hydrotreater maintained at about 700°–720° F. Benzene conversion increases as temperature in the second stage increases. Benzene conversions of only about 10–15%. for the full range and 210° F.+ naphthas at 600° F. in the second stage is attributed to aromatics saturation in the first stage as the catalyst is inactive at temperatures of 600° F. and lower. However, depending upon the feedstock and second stage temperature, benzene conversions of up to 47% are achieved in the second stage, as shown in FIG. 1.

Figure 2:
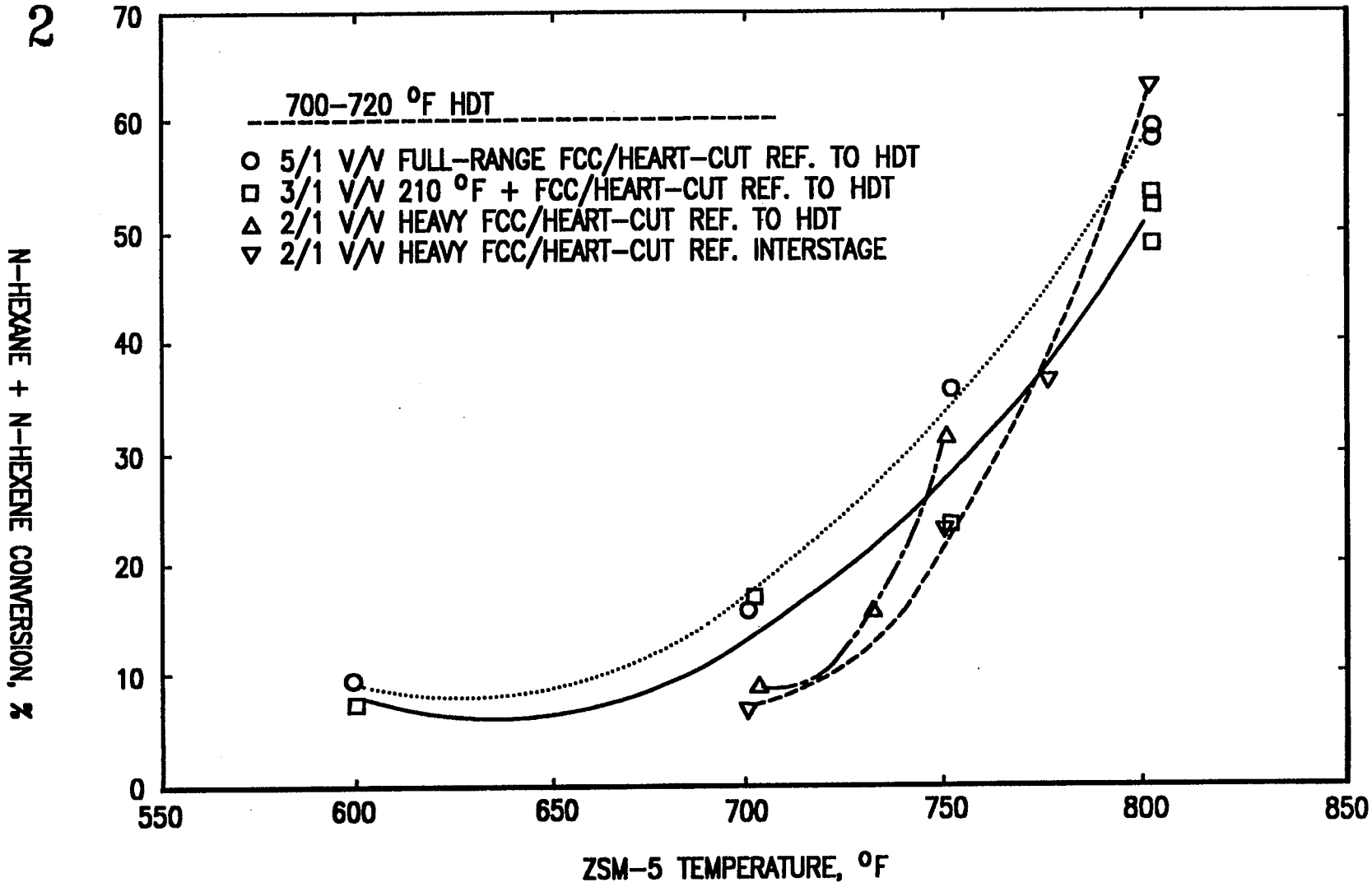
FIG. 2 is a plot of % N-hexane and N-hexene conversions v. temperature in the second stage of the process.

FIG. 2 is a plot of % benzene conversion of each of the feeds used in the above examples v. temperature in the second stage based on the data of the examples with the hydrotreater maintained at about 700°–720° F. Significant conversions of normal paraffins are achieved in the second stage for each of the feeds, depending upon the second stage temperatures. Normal paraffin conversions at 600° F. or lower are low because the ZSM-5 catalyst is inactive at these temperatures. Paraffin cracking at the higher temperatures, e.g. 700° F.+ is apparent from the plot which shows conversions up to 60%. The n-paraffin conversion is determined by the sum of n-hexane+n-hexene since in the first stage normal olefins are converted to normal paraffins.

We claim:

1. A process of upgrading an olefinic sulfur-containing catalytically cracked fraction having a 95% point of at least about 325° F. and boiling in the gasoline boiling range which comprises the steps of:

contacting the sulfur-containing catalytically cracked fraction with a hydrodesulfurization catalyst in a first reaction zone operated under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone over a catalyst of acidic functionality to effect cracking of heavy paraffins to lighter paraffins and cracking of low octane n-paraffins in the intermediate product; and co-contacting a benzene-rich fraction in the first reaction zone and/or the second reaction zone to produce a product in the second reaction zone which contains alkylbenzene formed by alkylation of the benzene with at least a portion of the cracked paraffins to produce a product in the second reaction zone comprising a fraction boiling in the gasoline boiling range having a higher octane number than the gasoline boiling range fraction of the intermediate product.

2. The process as claimed in claim 1 in which the benzene-rich fraction has an end boiling point of about 250° F.

3. The process as claimed in claim 1 in which the benzene-rich fraction has an end boiling point of about 230° F.

4. The process as claimed in claim 1 in which the benzene-rich fraction boils between 100° F. and 212° F.

5. The process as claimed in claim 1 in which the benzene-rich fraction contains at least 5 vol. % benzene.

6. The process as claimed in claim 5 in which the benzene-rich fraction is a reformate fraction.

7. The process as claimed in claim 1 in which the benzene-rich fraction is a light FCC naphtha, coker naphtha or pyrolysis gasoline.

8. The process as claimed in claim 1 in which the benzene-rich fraction is introduced to the first reaction zone.

9. The process as claimed in claim 1 in which said sulfur-containing feed fraction comprises a light naphtha fraction having a boiling range within the range of $C_5$ to 330° F.

10. The process as claimed in claim 1 in which said sulfur-containing feed fraction comprises a heavy naphtha fraction having a boiling range within the range of 330° to 412° F.

11. The process as claimed in claim 1 in which the catalyst of acidic functionality comprises a zeolite which has the topology of ZSM-5.

12. The process as claimed in claim 1 in which the sulfur-containing feed fraction comprises a full range naphtha fraction having a boiling range within the range of $C_5$ to 412° F.

13. The process as claimed in claim 11 in which the zeolite is in the aluminosilicate form.

14. The process as claimed in claim 1 in which the hydrodesulfurization catalyst comprises a Group VIII and a Group VI metal.

15. The process as claimed in claim 1 which is carried out in two stages with an interstage separation of light ends and heavy ends with the heavy ends fed to the second reaction zone.

16. The process as claimed in claim 6 in which the reformate is derived, at least in part, from the product of the first reaction zone.

17. The process as claimed in claim 11 in which the catalyst of acidic functionality comprises a zeolite which has the topology of ZSM-5 and further comprises a silica binder.

18. The process as claimed in claim 11 in which the catalyst of acidic functionality comprises a zeolite which has the topology of ZSM-5 and further comprises an alumina binder.

19. A process of upgrading a sulfur-containing catalytically cracked olefinic fraction boiling in the gasoline boiling range and having a 95% point of at least about 325° F. to about 440° F. and a benzene-rich fraction which comprises:

hydrodesulfurizing the catalytically cracked, olefinic, sulfur containing fraction with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed; and contacting at least the gasoline boiling range portion of the intermediate product and the benzene-rich fraction in a second reaction zone with a catalyst of acidic functionality to effect cracking of heavy paraffins to lighter paraffins and cracking of low octane n-paraffins in the intermediate product and alkylation of benzene with at least a portion of the cracked paraffins to produce a product which comprises a fraction boiling in the gasoline boiling range having a higher octane number than the gasoline boiling range fraction of the intermediate product.

20. The process as claimed in claim 19 in which the benzene-rich fraction boils between 100° F. and 212° F.

21. The process as claimed in claim 19 in which the benzene-rich fraction is a light FCC naphtha, coker naphtha or pyrolysis gasoline.

22. The process as claimed in claim 19 in which the benzene-rich fraction has a benzene content above 5%.

23. The process as claimed in claim 19 in which the benzene-rich fraction is a reformate fraction.

24. The process as claimed in claim 23 in which the reformate is derived, at least in part, from the product of the first reaction zone.

25. The process as claimed in claim 19 in which the temperature of the benzene-rich fraction is at least 50° F. higher than the temperature of the intermediate product.

26. The process as claimed in claim 19 in which said feed fraction comprises a naphtha fraction having a 95 percent point of at least about 380° F.

27. The process as claimed in claim 19 in which the acidic catalyst of the second reaction zone comprises a zeolite having the topology of ZSM-5.

28. The process as claimed in claim 27 in which the acidic catalyst of the second reaction zone comprises a zeolite having the topology of ZSM-5 and further comprises a silica binder.

29. The process as claimed in claim 27 in which the acidic catalyst of the second reaction zone comprises a zeolite having the topology of ZSM-5 and further comprises an alumina binder.

30. A process of upgrading a sulfur-containing olefinic catalytically cracked fraction boiling in the gasoline boiling range having a 95% point of at least about 325° F. to about 440° F. and a benzene-rich fraction which comprises:

co-contacting the sulfur-containing feed fraction and the benzene-rich fraction with a hydrodesulfurization catalyst in a first reaction zone, operating under a combination of elevated temperature and elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone with a catalyst of acidic functionality to effect cracking of heavy paraffins to lighter paraffins and cracking of low octane n-paraffins in the intermediate product and alkylation of the benzene with at least a portion of the cracked paraffins to produce a product in the second reaction zone comprising a fraction boiling in the gasoline boiling range having a higher octane number than the gasoline boiling range fraction of the intermediate product.

31. The process as claimed in claim 30 in which the sulfur-containing feed fraction comprises a light naphtha fraction having a boiling range within the range of $C_5$ to 330° F.

32. The process as claimed in claim 30 in which the sulfur-containing feed fraction comprises a heavy naphtha fraction having a boiling range within the range of 330° to 412° F.

33. The process as claimed in claim 30 in which the sulfur-containing feed fraction comprises a full range naphtha fraction having a boiling range within the range of about $C_5$ to 412° F.

34. The process as claimed in claim 30 in which the benzene-rich fraction is a reformate fraction.

35. The process as claimed in claim 30 in which the acidic catalyst of the second reaction zone comprises a zeolite having the topology of ZSM-5.

36. The process as claimed in claim 35 in which the acidic catalyst of the second reaction zone comprises a zeolite having the topology of ZSM-5 and further comprises a silica binder.

37. The process as claimed in claim 35 in which the acidic catalyst of the second reaction zone comprises a zeolite having the topology of ZSM-5 and further comprises an alumina binder.

* * * * *